US005715537A

United States Patent [19]

Pagano

[11] Patent Number: 5,715,537

[45] Date of Patent: Feb. 10, 1998

[54] FORM-FITTING COAT CONSTRUCTION

[76] Inventor: Ralph R. Pagano, 9201 Shore Rd., Brooklyn, N.Y. 11209-6569

[21] Appl. No.: 800,082

[22] Filed: Feb. 12, 1997

[51] Int. Cl.[6] ..... A41D 1/00

[52] U.S. Cl. ..... 2/93; 2/272; 2/85

[58] Field of Search ..... 2/93, 85, 272, 2/97

[56] References Cited

U.S. PATENT DOCUMENTS 2,121,836 6/1938 Steinberger ..... 2/93

3,812,540 5/1974 Pagano ..... 2/97

*Primary Examiner*—Gloria Hale

*Attorney, Agent, or Firm*—Hopgood, Calimafde, Kalil & Judlowe, L.L.P.

[57] ABSTRACT

A form-fitting coat construction having two front panels with an interliner secured to each panel. The interliner is a stiff fabric that when secured to the fabric panel has a grain orientation the same as that of the fabric panels. The interliner may include primary and secondary chest pieces under the interliner to form a composite. The primary chest piece can be comprised of a felt material and the secondary chest piece can be comprised of hair cloth. This interliner structure prevents puckering and cockles in coats.

3 Claims, 1 Drawing Sheet

FORM-FITTING COAT CONSTRUCTION

This invention relates to the construction of coats and, in particular, to form-fitting jackets.

BACKGROUND OF THE INVENTION

In my U.S. Pat. No. 3,812,540, the subject matter of which is incorporated herein by reference, I disclose and claim a form-fitting jacket construction, including two front panels and an interlining secured to the inside of said panels. The invention disclosed in the aforementioned patent resides in the use of a dart vertically aligned and substantially equidistant of a generally vertical centerline of the arm hole, with the center line of the arm hole falling along the center of the side of a wearer's torso.

While the aforementioned invention has been very successful in providing a form-fitting jacket, it later became apparent that there was a tendency for the jacket to bunch up in the chest area of the front panels due to "puckering," "formation of "cockles" including "shapeless" shoulders and the like.

According to Merriam Webster's Dictionary (10th ed., 1995), "puckering" is defined as a tendency of a surface, for example, a cloth, to wrinkle or contract into folds or wrinkles. This occurs in the chest area of a jacket.

The term "cockles" is defined in the dictionary as equivalent to "pucker" and "wrinkles."

I have found that the foregoing problem can be substantially eliminated as will clearly appear from the following disclosure, the drawing and the appended claims.

OBJECTS OF THE INVENTION

It is the object of the present invention to provide a front panel/interliner construction in which puckering, wrinkles, cockles and the like are substantially eliminated.

Another object of the present invention is to provide a new and improved jacket construction in which the outer chest portion of the jacket is relatively smooth when worn by a person.

These and other objects will clearly appear when taken in conjunction with the drawing and the following disclosure.

IN THE DRAWING

SUMMARY OF THE INVENTION

Stating it broadly, the form-fitting coat construction includes two front panels (right and left) to the backside of each is secured a multi-layered interlining comprising a main first layer of stiff fabric extending from top to bottom of each front panel, having sandwiched therebetween primary and secondary sub-linings or chest pieces disposed in the chest area of the panels. The layer of the linings are fused and secured to the panels. The improvement resides in the fact that each of said panels has a grain orientation running vertically therealong when the coat is worn with the main interlining having the same grain orientation as that of the panels such that, when the jacket is worn, the tendency to form cockles, puckering and shapeless shoulders is substantially eliminated.

According to the aforementioned dictionary, "grain" with respect to textiles, is defined as the direction of the threads in a cloth, otherwise referred to herein as grain orientation.

DETAILS OF THE INVENTION

Figure 2:
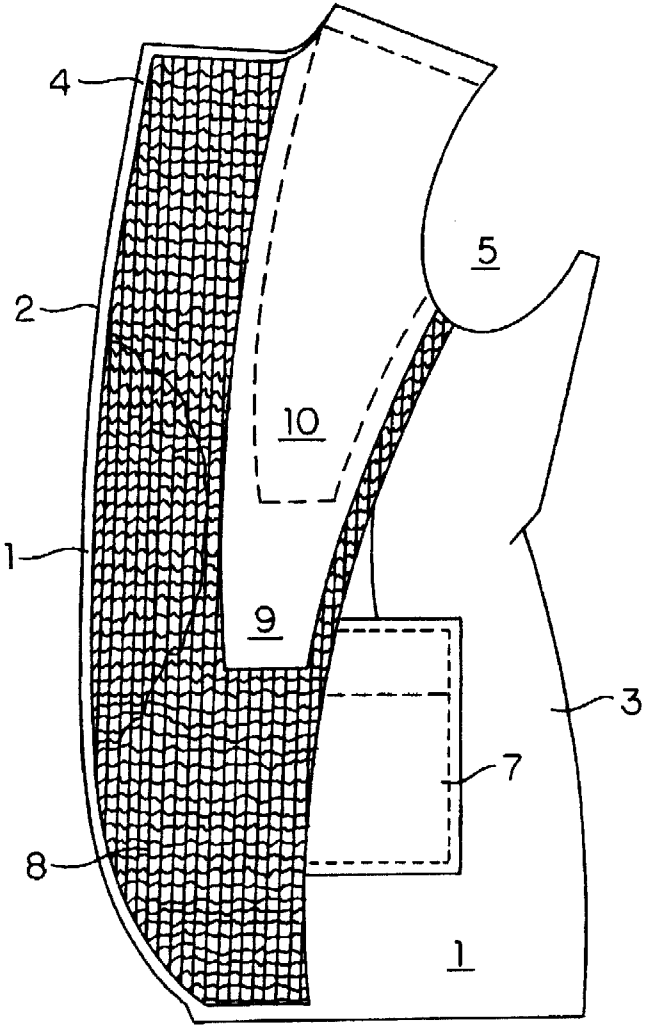
FIG. 2 is a view of the underside of a front panel assembly in which the interlining is partially broken away to reveal the grain orientation of the fabric of the panel which coincides with the grain orientation of the interlining according to the invention.
Figure 1:
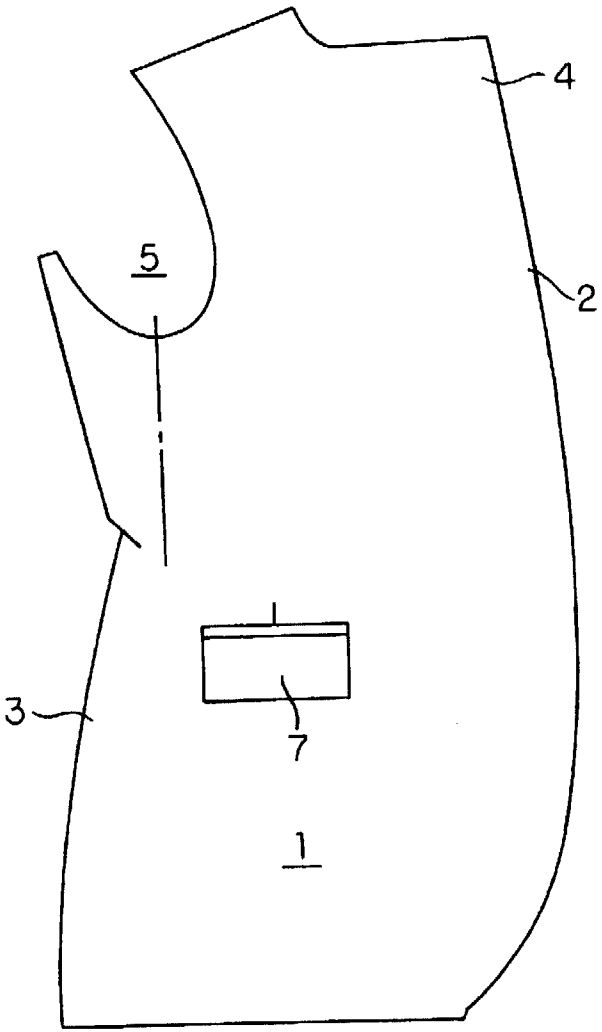
FIG. 1 is an overview of the face area of an assembled front panel with the interliner secured thereto out of view on the inside of said panel.

FIGS. 1 and 2 of the drawing show the general construction of the coat of the invention utilizing grain control or grain orientation of that of the panel and that of the main or first interlining, such that the grain orientation of one is the same as that of the other in the vertical direction with respect to the torso of the wearer when the interlining is secured as to the inside face of each of the front panels.

This is important in that the downward pull of gravity when the jacket is worn does not produce angular forces between the panel and the interliner and cause the panel to wrinkle or form cockles in the area of the chest of the front panels.

It is not uncommon when a tailor works with an interlining material or fabric to cut it every which way in order to obtain the most out of a bolt of cloth, such that the grain orientation of the if interliner is not the same as that of the panel when secured to the panel.

Referring to FIG. 1, the front panel 1 has a front edge 2, side edge 3, a lapel portion 4 and an armhole 5.

A side pocket 7 is generally provided in the usual location as shown in the drawings.

On the underside of the jacket shown in FIG. 1, the main interliner 8 is secured as is clearly shown in FIG. 2. The main interliner 8 includes several superimposed primary and secondary layers as chest pieces, in this instance, layer 9, and layer 10.

As stated herein, layer 8 is the main interlining; layer 9 is a primary covering layer in the chest area and layer 10 is a secondary layer located beneath the primary layer 9 in the chest area.

The primary and secondary layers are preferably made of non-woven material. For example, the primary layer 9 may be felt material and the secondary layer 10 made of hair cloth.

In preparing the interliner, all three layers 8, 9 and 10 are positioned as shown in FIG. 2.

The three layers are preferably heat fused together to form a composite interliner structure secured to the inside face of each of the front panels.

Referring to FIG. 2, the composite interlining is shown secured to the inner face of the front panel. The main interliner layer 8 which covers substantially the entire inner face of the panel is broken away to reveal the grain orientation of the fabric of the front panel beneath layer 8 with the grain orientation of the fabric of the panel being the same as the grain orientation of main interliner layer 8.

In summary, the invention is directed to a form-fitting coat construction in which the coat or jacket includes two front panels to each of which is secured a multi-layered interlining comprising a main first layer of stiff fabric 8 which covers the inside of the panel and primary and secondary chest pieces disposed between the main interliner 8 and the front panel.

The improvement resides in the fact that grain orientation of the interliner is the same as that of the fabric of the panel. By matching the grain orientation of the panel with that of the main interliner 8, the formation of cockles, wrinkles and bunching of the fabric is substantially eliminated.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. In a form-fitting coat construction comprising two front panels to which an interliner is secured to each panel, said interliner comprising a stiff fabric for covering each of the panels and optionally including primary and secondary chest pieces located beneath said interliner to form a composite, and the interliner being secured to the inside of each of the panels, the improvement:

wherein the stiff fabric of said interliner when secured to each of said panels has a grain orientation the same as that as the fabric of the panels, wherein said grain orientation runs vertically along the interliner the same as that of the fabric of the panel, such that the panels of the form-fitting coat when worn are substantially free of cockles, wrinkles, and bunching up of the fabric in the area of the chest covered by said panels.

2. The form-fining coat as in claim 1, wherein the interliner is comprised of three layers comprising a main layer formed of said stiff fabric, and primary and secondary chest pieces fused to said main layer, said primary chest piece being comprised of a felt material and said secondary chest piece being comprised of hair cloth.

3. The form-fitting coat as in claim 1, wherein the interliner is comprised of two layers comprising a main layer formed of said stiff fabric and a primary chest piece.

* * * * *